United States Patent [19]

Faul et al.

[11] Patent Number: 4,576,677

[45] Date of Patent: Mar. 18, 1986

[54] METHOD AND APPARATUS FOR REGENERATING AN AMMONIACAL ETCHING SOLUTION

[75] Inventors: Wolfgang Faul; Leander Fürst, both of Jülich; Walter Holzer, Meersburg; Bertel Kastening, Hamburg, all of Fed. Rep. of Germany

[73] Assignee: Kernforschungsanlage Jülich GmbH, Jülich, Fed. Rep. of Germany

[21] Appl. No.: 598,087

[22] Filed: Apr. 9, 1984

[30] Foreign Application Priority Data

Apr. 13, 1983 [DE] Fed. Rep. of Germany ..... 3313293
Nov. 8, 1983 [DE] Fed. Rep. of Germany ..... 3340343

[51] Int. Cl.[4] ..... C23F 1/00; B44C 1/22; C03C 15/00; C03C 25/06

[52] U.S. Cl. ..... 156/642; 156/345; 156/666

[58] Field of Search ..... 156/642, 656, 659.1, 156/666, 345; 134/10, 13; 75/117; 204/106

[56] References Cited

U.S. PATENT DOCUMENTS

| | | | |
|---|---|---|---|
| 3,843,504 | 10/1974 | Nayder | 156/642 X |
| 4,083,758 | 4/1978 | Hamby et al. | 156/642 X |
| 4,252,621 | 2/1981 | Reinhardt et al. | 156/642 X |
| 4,329,210 | 5/1982 | Merchant et al. | 156/642 X |

FOREIGN PATENT DOCUMENTS 2008766 7/1971 Fed. Rep. of Germany .

*Primary Examiner*—William A. Powell
*Attorney, Agent, or Firm*—Frishauf, Holtz, Goodman & Woodward

[57] ABSTRACT

Ammoniacal etching solution containing metal ions as the result of etching is withdrawn from an etching bath and while part of it goes to an electrolysis cell for removal of metal ion, the remainder goes back to the etching bath through a liquid jet pump in which it serves as the working liquid, while the pump sucks in from the electrolysis cell the anodically evolved oxygen. The thorough mixing of the oxygen into the etching solution performed by the pump results in oxidation so rapid that in many cases it becomes unnecessary to suspend catalyst particles in the electrolyte to accelerate the oxidative regeneration of the etching solution. Where use of such particles is still desired, the solution drawn from the etching bath goes through a cylindrical filter unit from which a filtrate is drawn off laterally for the electrolysis cell, while the remainder of the input goes to the jet pump. Controls are provided for using the electrolysis cell only when the metal ion concentration is above a predetermined value, for adding ammonia to the oxygen line in order to maintain a particular value of pH and for controlling the temperature of the electrolyte in the electrolysis cell in order that a desired quantity of water can be condensed from the oxygen line for use in rinsing the work pieces after they are taken out of the etching bath.

19 Claims, 3 Drawing Figures

METHOD AND APPARATUS FOR REGENERATING AN AMMONIACAL ETCHING SOLUTION

The invention concerns a process for regenerating an ammoniacal etching solution by which oxygen is added for reoxidation of the etching agent contained in the etching solution, and in which the etching solution flows at least in part through an electrolysis cell for recovering etched-off metal, which is cathodically deposited while oxygenis produced at the anode of the electrolysis cell. The invention also concerns an apparatus for carrying out of this process.

Alkaline etching agents are used for etching metal objects, especially in the manufacture of circuit boards, which are also known under the designation "printed circuits," especially when metal portions of the circuit boards to be etched are not resistant to acid etching agents, which is the case, for example for the metals lead, tin or nickel. Reoxidation of alkaline etching solution, after etching-off of metal, is carried out with the addition of ammonia gas and/or ammonium chloride in the presence of oxygen or air.

It is known from German published patent application (OS) No. 30 31 567 to suspend catalyst particles in the etching solution which accelerate the etching itself and also the reoxidation of the solution and thus to mitigate or avoid the use of oxidation agents which produce toxic residual solutions. In the known method, the etched-off metals are deposited in an electrolysis cell. A part of the solution, which contains ammonium sulfate, flows through the electrolysis cell. The etched-off metals are separated out at the cathode of the electrolysis cell, while oxygen is produced at the anode.

In the known process just described, the etching solution containing the catalyst particles is sprayed in air for reoxidation. This takes place directly in the etching chamber by spraying the etching solution onto the work pieces to be treated. Reoxidation with air is not of advantage in all cases. The disadvantage is particular because ammonia is added to the etching solution for setting the pH value at a desired level and the evolution of fumes and other environmental problems resulting from evaporating ammonia are to be kept as small as possible.

SUMMARY OF THE INVENTION

It is an object of this invention to mix the etching solution intensively with a gas in a simple way and thereby to obtain a high oxygen content.

Briefly, oxygen produced at the electrolysis cell is introduced into the etching solution. Consequently, a little or no gas is introduced into the etching solution that does not participate in reoxidation, in contrast with the presence of a nitrogen when air was used for reoxidation. In addition, a ready and immediate use for the oxygen produced in the electrolysis lends a certain economy to the process. It is preferred to add ammonia along with the oxygen to etching solution in order to set the pH value of the solution at the appropriate level. The amount of ammonia that needs to be added to the etching solution is enough for essentially replacing the ammonia that is lost by evaporation during etching in the etching chamber and during regeneration of the etching solution.

The ammonia that escapes in the gas chamber above the electrolyte during regeneration of the solution in the electrolysis cell can readily be put back into the solution along with the oxygen removed from above the electrolyte by suction without any additional handling procedure. That ammonia and the ammonia supplementarily added carried into the etching solution with the oxygen and, like the oxygen, is intensively mixed with the etching solution. This intensive mixing and fine distribution of the gases containing the oxygen accelerates the reoxidation.

The regeneration apparatus according to the invention comprises a pipe or duct connectable to an etching chamber for removing the etching solution from the chamber. The removed etching solution is put through a filter which does not let through the catalyst particles that are suspended in the etching solution. The catalyst particles are removed from the filter by means of etching solution that can be caused to flow back into the etching chamber. An electrolysis cell is part of the regeneration equipment and also a line connecting the cell with the filter, which is a line from the filter carrying etching solution filtrate now free of catalyst particles . The electrolysis cell also has an output line for supplying etching solution of reduced metal ion content, as fresh etching solution for the etching chamber. An oxygen line for oxygen produced at the anode of the electrolysis cell discharges into the return line to the etching chamber for etching solution containing catalyst particles. Intensive mixing of the oxygen etching solution accelerates the reoxidation.

The supply line for ammonia for addition into the oxygen line is preferably controlled by a valve so that the pH value of the etching solution can be regulated simultaneously with the supply of oxygen to the solution. A liquid jet pump serves for introducing the oxygen and ammonia, the pump being installed in the line leading into the etching chamber. A more rapid reoxidation is obtained with the liquid jet pump by means of the fine distribution of the oxygen in the etching solution. The oxygen line from the electrolysis cell ends at the suction inlet pipe of the liquid jet pump, while the etching solution containing the catalyst particles flows in at the inlet for the working liquid of the pump. Upstream of the pump a pressure-relief line branches off from the line bringing etching solution to the pump. The pressure-relief line discharges into a collecting container which is connected with the etching chamber for accepting etching solution removed therefrom. The collecting container is connected to the etching chamber in such a way that the etching solution flows by gravity into the collection container, which may be referred to as a catch basin.

In order to produce the necessary working fluid pressure in the liquid jet pump, the filter, from which the filtrate flows to the electrolysis cell, is disposed above the liquid jet pump in such a way that the etching solution containing the catalyst particles flows by gravity into the liquid jet pump. The filter, accordingly, has a tubular filter insert which is disposed vertically above the liquid jet pump.

The intensive mixing of the oxygen with the etching solution and its fine distribution, which are obtained especially by introducing the oxygen from the gas chamber of the electrolysis cell by means of the liquid jet pump, accelerate the reoxidation of the etching solution to such an extent that it is possible to dispense with the catalyst particles in such case in which a slight underetching of the metal profile resulting by etching is admissible. This simplifies the etching process. If no catalyst particles are contained in the etching solution, the filter protecting the electrolysis cell against the introduction of catalyst particles can also be dispensed with.

Water vapor is carried out of the gas chamber of the electrolysis cell by the removal of the oxygen and ammonia by suction. In order to remove that water vapor before the gas mixture is introduced into the etching solution, it is advantageous, as further development of the invention, to interpose a condenser in the oxygen line connected to the gas chamber above the electrolyte of the electrolysis cell, in which condenser the gas mixture is cooled and water vapor separated. The condensed water is used as rinse water for the etched work pieces and thereby reduces the total amount of rinsing medium needed by the process. The condensate line leading the condensate from the condenser discharges into the last rinsing chamber of the installation. It is advantageous that the water separated in the condenser contains ammonia. Upon entrance of the condensate into the rinsing chamber, accordingly, no hydrolysis of the copper tetrammine complex contained in the etching solution, in the case of copper etching, can take place which would lead to the precipitation of copper hydroxide or basic copper salt on the work piece surface under treatment. The amount of water vapor produced in the electrolysis cell depends upon the temperature in the cell. With rising electrolyte temperature, the water vapor content rises in the gas chamber above the electrolyte and, accordingly, more condensate can then be recovered in the condenser. By appropriately setting the temperature in the electrolysis cell, it is therefore possible to regulate the condensate quantity produced. The maximum temperature in the electrolysis cell is limited by the necessary pH value in the electrolyte. The pH value drops with increasing temperature, since the ammonia content in the electrolyte likewise falls. The electrolyte must in any event remain alkaline for protection of the electrodes.

BRIEF DESCRIPTION OF THE DRAWINGS

The invention is further described by way of illustrative examples with reference to the annexed drawings, which are schematic in character, and in which.

DESCRIPTION OF THE ILLUSTRATED EMBODIMENTS

Figure 1:
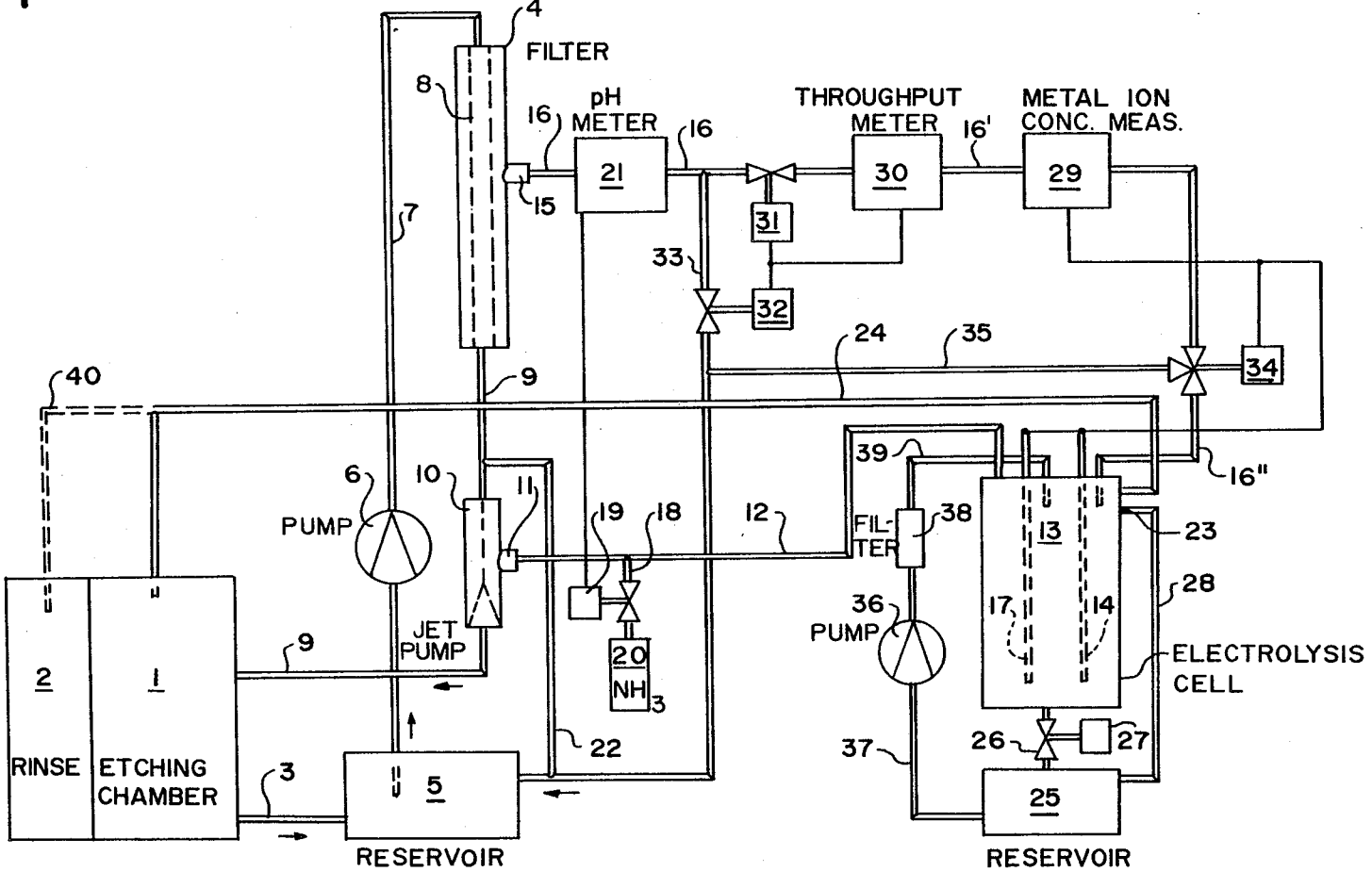
FIG. 1 is a schematic diagram of an installation of etching apparatus for an etching solution containing catalyst particles.

In FIG. 1 there is shown an etching chamber 1, with attached rinsing chamber 2, to which the etchant regeneration system represented by the remainder of FIG. 1 is connected. Etching is effected by spraying the etching solution onto the work pieces or by dipping them into an etching bath. The etchant to be regenerated in the illustrated system is an ammoniacal solution containing ammonium sulfate in combination with copper tetrammine complex as the etching agent and having catalyst particles suspended therein. This solution flows out of the ething chamber 1 through a pipe or similar duct 3 towards a filter 4. The catalyst particles contained in the etching solution serve to raise the etching speed and/or to accelerate the reoxidation of the etching solution. Particles suited for such catalysis are, for example, activated carbon particles such as those described in German published patent application (OS) No. 3 031 567.

In the embodiment illustrated in FIG. 1, the duct 3 is connected to the etching chamber 1 in such a way that the etching solution first flows by gravity into a collecting container 5. It is then propelled by means of a pump through a pressure line 7 to the filter 4. The complete supply line or duct furnishing the solution from the etching chamber to the filter accordingly includes the duct 3 itself, the collecting container 5, the pump 6, which may be a suspension pump located within the container 5, and also the pressure line 7.

The filter 4 is equipped with a filtering insert 8 which will not pass the catalyst particles suspended in the etching solution. In the illustrated example, the filter insert 8 is cylindrical in shape and is shown in broken lines in the drawing. The filter 4 is disposed vertically and the etching solution containing catalyst particles flows down through it from above. A return line 9 leads back from the filter 4 to the etching chamber 1, in which etching solution containing catalyst particles is led back into the etching chamber.

For reoxidation of the etching solution returning to the etching chamber, oxygen is introduced into the solution. For this purpose, a liquid jet pump 10 is inserted in the return line 9 having its suction pipe coupling 11 connected to an oxygen line 12. The etching solution flowing down out of the filter 4 and containing catalyst particles serves as the working liquid of the jet pump 10.

The oxygen line 12 leads oxygen out of an electrolysis cell 13. A portion of the etching solution flows through the electrolysis cell for separating out metal etched away in the etching chamber. Only etching solution free of catalyst particles is to be supplied to the electrolysis cell. For this purpose, a connection line 16, 16', 16'' is provided between the filtrate outlet 15 of the filter 4 and the electrolysis cell 13. Oxygen evolves at the anode 17 of the electrolysis cell. The oxygen line 12 connects to the gas chamber above the electrolyte of the electrolysis cell and is supplied with oxygen therefrom when the liquid jet pump is in operation. Along with oxygen, the gas chamber of the electrolysis cell contains also ammonia and water vapor which evaporate out of the electrolyte in accordance with their respective vapor pressures.

Leading into the oxygen line 12 is an ammonia supply line 18 which is connected to an ammonia supply container 20 through the valve 19 by which the flow can be completely cut off. Fresh ammonia can thus be introduced by the liquid jet pump 10 line, with oxygen sucked off the top of the electrolysis cell, into the etching solution containing the catalyst particles, so that the ammonia addition may regulate the pH value of the etching solution. The valve 19 is, accordingly, interconnected for control purposes with a measuring electrode of a pH measuring device 21 inserted in the connecting line 16. If the pH falls below a prescribed permissible minimum, the valve 19 is open and ammonia is introduced into the etching solution. The pH measuring device switches the valve 19 by means of electrical control equipment not specifically shown in the drawing.

A pressure relief line 22 branches off from the return line 9 between the filter 4 and the liquid jet pump 10 and leads etching solution into the collecting container 5 to the extent appropriate for relief of overpressure.

At the overflow outlet 23 of the electrolysis cell, a line 24 leads etching solution with depleted metal iron content to the etching chamber 1, where it is mixed as fresh etching solution with the etching solution containing catalyst particles.

A draining container 25 is located below the electrolysis cell 13. It serves for emptying the electrolsis cell and is connected at the bottom of the electrolsis cell 13, through a discharge 26 which can be opened or closed by a magnetic valve 27. Etching solution can also flow out of the electrolysis cell 13 into the drain container 25 through a second overflow 28. In addition to the pH measurement device 21 in the connecting line 16, there is located a throughput measuring device 30 and similarly between the line 16' and the line 16'', a device 29 for measuring metal ion concentration.

The throughput meter 30 measures out the amount of etching solution that is to be supplied to the electrolysis cell 13. In the illustrated example it cooperates with two flow control valves 31 and 32. The throughput meter 30 can control the setting of these valves, for example, mechanically or hydraulically, but it could also operate them electrically, if that should be desirable or convenient. In the latter case, magnetic valves can be installed as the flow control devices 31 and 32. Of these two valves, the valve 31 is inserted in the connecting line 16 and the valve 32 in a bypass 33 branching off from the line 16 upstream of the valve 31. The two control valves are set in such a way that constant etching solution flow is maintained in the connection line 16 leading to the electrolysis cell. The volume of etching solution to be introduced into the electrolysis cell per unit of time depends upon the quantity of metal that can be separated and deposited in the electrolysis cell in this same unit of time.

The metal ion concentration in the etching solution measured by the apparatus 29 determines the extent of operation of the electrolysis cell. The apparatus 29 is operatively connected with a three-path valve 34 connected at the end of the middle piece 16' of the connection line 16 and also connected to the end piece 16' thereof, which leads to the electrolysis cell 13 and having a third connection to the bypass line 35 that leads to the bypass 33. The three-path valve 34 is normally open to the electrolysis cell 13 for solution coming from the line 16'. If the metal ion concentration of the etching solution falls below a predetermined value, the valve 34 is switched over and the etching solution then flows around the bypass 35. The electrolysis cell is then shut off. A solution pump 36 provides for circulation of the etching solution in the electrolysis cell 13. Its suction line 37 dips into the drain into which the etching solution flows through the overflow line 28. The pump 36 supplies the etching solution back to the electrolysis cell through a filter 38 interposed in the pressure line 39. In the illustrated example, the etching solution enters the cell between the cathode 14 and the anode 17. After the electrolysis cell is shut off, the etching solution is emptied into the draining container 25 by opening the magnetic valve 27. Before renewed operation of the electrolysis cell, the etching solution is fed back into the electrolysis cell by means of the solution pump 36.

In the illustrated example, an etching solution containing ammonium sulfate and copper tetrammine complex is used for etching of copper. After the separation at the cathode of the metal that has been etched off and the liberation of oxygen at the anode, the etching solution, now depleted of metal ions can be used as a rinsing solution for rinsing the work pieces etched in the etching chamber 1 after the termination of the etching treatment. The etched work pieces need to be cleaned, in particular, of catalyst particles still adhering thereto. The amount of etching solution needed for this purpose can be taken from the overflow line 24. A rinsing line 40 connectible to the overflow 24 and leading to the rinsing chamber 2 is accordingly shown in broken lines in FIG. 1. The rinsing chamber 2 and the etching chamber 1 are so connected to each other that the etching solution can overflow into the etching chamber after the rinsing operation.

FIG. 1 shows a regeneration installation for an etching solution in which catalyst particles are suspended. If by the introduction of oxygen through the liquid jet pump and intensive mixing in of the oxygen with the etching solution, its finely divided distribution should be sufficient for rapid reoxidation of the solution, the catalyst particles can be dispensed with and the regeneration installation considerably simplified. The filter 14 inserted in the pressure line 7 is eliminated. Instead thereof, there remains, as shown in the illustrative embodiment of FIG. 2, a simple pipe connection 41 between the pressure line 7 and the connecting line 16.

Figure 2:
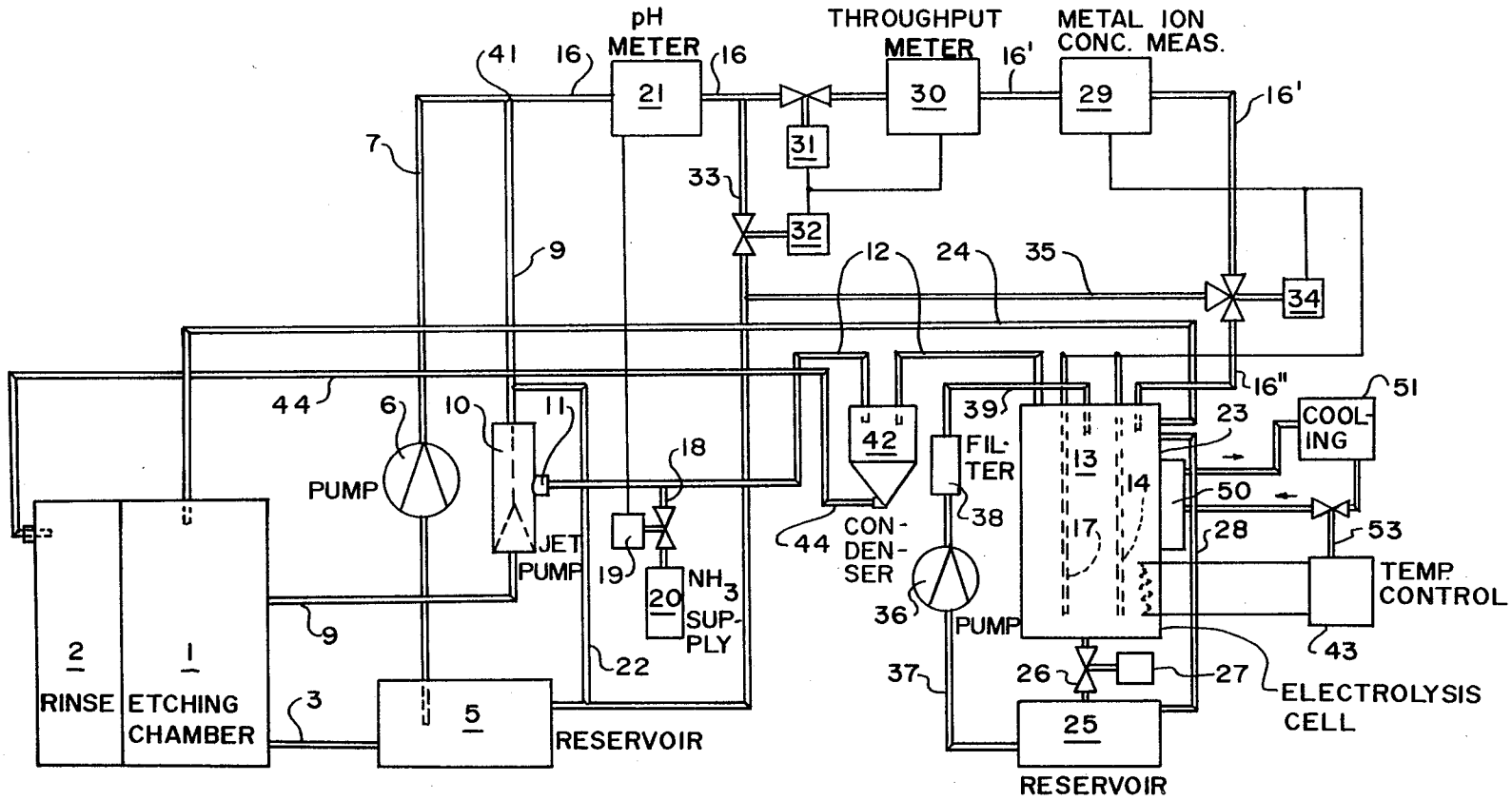
FIG. 2 is a schematic diagram of an etching apparatus installation for an etching solution free of catalyst particles, the installation including a condenser for producing rinse water and, FIG. 3 is a graph showing the reoxidation time for an etching solution in which oxygen is introduced by means of a liquid jet pump, compared to the case of an etching solution oxidized by spraying in the etching chamber.

Insofar as the regeneration system of FIG. 2 has individual parts unchanged from their form in FIG. 1, the same reference symbols as in FIG. 1 are provided in FIG. 2. The installation shown in FIG. 2 contains a feature which could also be used to complete or improve the system of FIG. 1, namely a condenser 42 in the oxygen line 12 and apparatus 43 for controlling the electrolyte temperature in the electrolysis cell 13. Water vapor is condensed and collected in the condenser 42 from the gas mixture sucked off from above the electrolyte of the electrolysis cell and containing also oxygen and ammonia. A condensate line 44 leads from the condenser 42 to the rinsing chamber 2 of the etching installation. The water separated in the condenser is used to rinse the etched work pieces. In order that sufficient amount of condensate should be producible in the condenser 42 by cooling the gas mixture drawn off by suction, the temperature in the electrolyte in the electrolysis cell is controlled by the apparatus 43. The amount of water vapor contained in the gas mixture rises with the electrolyte temperature. The apparatus 43 serves essentially for cooling the cell which warms up during its operation as the result of the passage of current. A constancy of temperature is obtained by equipping the electrolysis cell with a cooling jacket through which water flows, illustrated symbolically at 50. The cool water quantity is controlled to regulate the temperature of electrolyte by the unit 51 responsive to the output 53 of the apparatus 43.

The embodiment of FIG. 2 also illustrates an installation for etching copper using an etching solution containing ammonium sulfate and copper tetrammine complex. In the electrolysis cell a temperature of 75° C. is established by cooling the electrolyte during the separation of the etched-off copper. About 5 $m^3/h$ of gas mixture is drawn out of the electrolysis cell from the gas space above the electrolyte by suction of the liquid jet pump. When the electrolysis cell is suitably enclosed for such operation, about 1.25 liters per hour of condensate is produced out of the gas mixture under these conditions in the condenser and used for rinsing. About 500 liters per hours of oxygen are evolved at the anode of the electrolysis cell with a current of 2400 A. The copper-containing etching solution introduced into the electrolysis cell in such operation was maintained at a pH value of 9.

Figure 3:
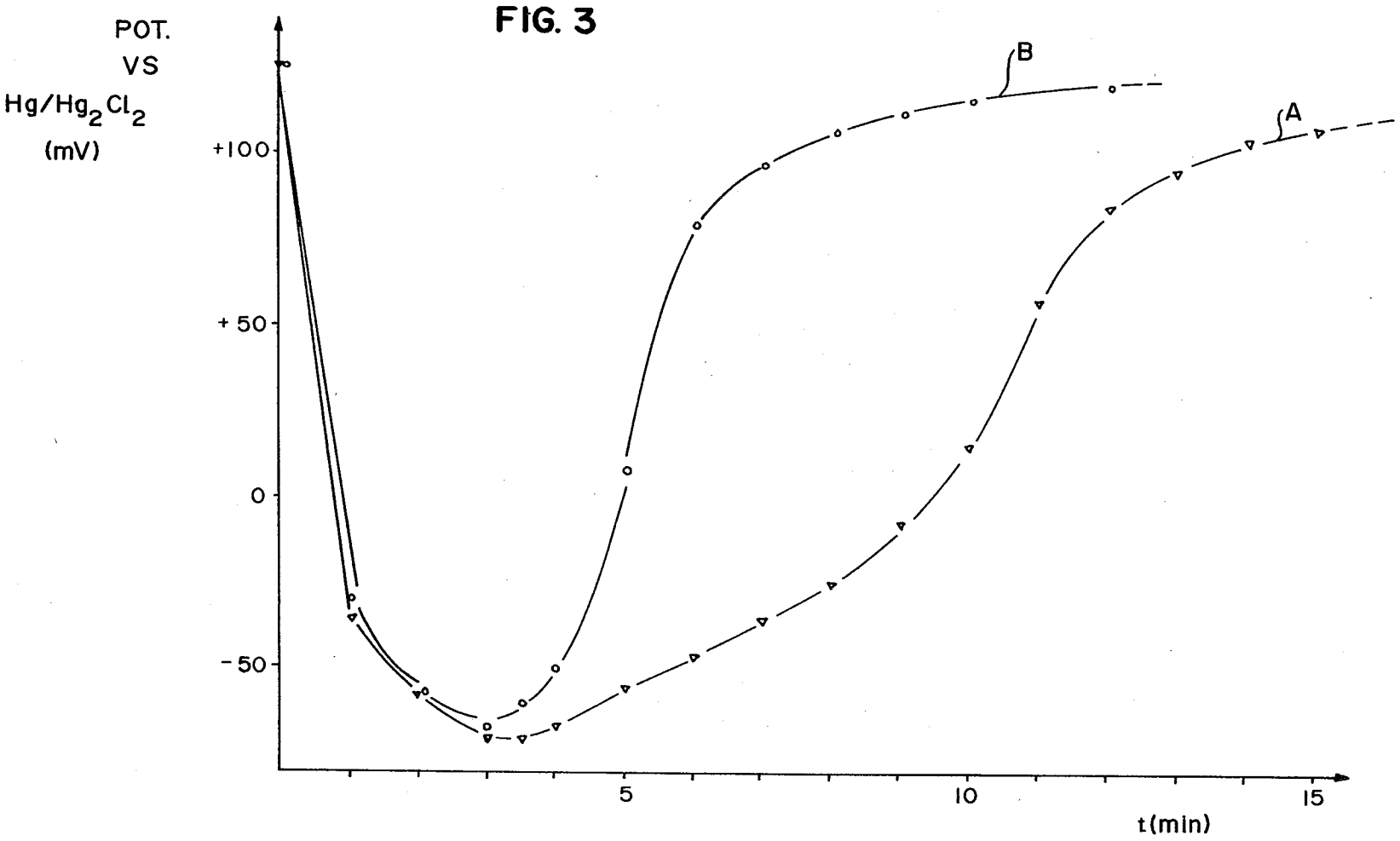

FIG. 3 shows the time of reoxidation for two kinds of oxidation. Curve A relates to reoxidation of the etching solution by simply spraying in the etching chamber, whereas curve B shows reoxidation by additive introduction of oxygen into the etching solution by means of the liquid jet pump. The reoxidation in the solution was measured by the potential of the $Cu^{++}/Cu^{+}$redox system measured against a calomel reference electrode ($Hg/Hg_2Cl_2$/saturated KC1).

With an etching solution containing copper tetrammine complex and ammonium sulfate with a copper content of 50 g/l and with 150 g/l $(NH_4)_2SO_4$, and with a pH of 9 maintained with ammonia, copper surfaces were etched at a temperature of 50° C. During the etching, the potential of the $Cu^{++}/Cu^{+}$redox system sank within $3\frac{1}{2}$ minutes etching time from an initial value of 125mV to about −60mV. After this etching time reoxidation began.

It can be seen from FIG. 3 that for the same amount of copper removal from the etching solution, the intensive introduction of oxygen into the etching solution by means of the liquid jet pump led to a clearly more rapid reoxidation than is the case for merely spraying the etching solution in the etching chamber. With the introduction of oxygen by means of the liquid jet pump, a potential of +100mV is already reached after about $3\frac{1}{2}$ minutes (after total time of 7 minutes in FIG. 3, since the first $3\frac{1}{2}$ minutes represent the etching). The same potential value is found in the spraying of the etching solution in the etching chamber only after $10\frac{1}{2}$ minutes. If air instead of oxygen is sucked out of the gas chamber of the electrolysis cell by means of the liquid jet pump, the reoxidation speed for the same copper removal is reduced, but the reoxidation nevertheless still runs substantially faster than the case of reoxidation according to curve A. The intensive oxygen mixing with the etching solution thus substantially improves the oxidative regeneration of the etching solution.

Although the invention has been described with reference to particular illustrative examples, it will be understood that variations and modifications are possible within the inventive complex.

We claim:

1. Method of regenerating an ammoniacal etching solution by re-oxidation comprising the steps of:

withdrawing an ammoniacal etching solution, which is at least partially spent and contains etched metals in ionic form, from an etching chamber;

leading a first part of said withdrawn solution in a first path leading back to said etching chamber, passing a second part of said solution withdrawn from said chamber through an electrolysis cell which has a cathode and an anode and in which said solution serves as the electrolyte during passage therethrough, whereby said metal contained therein is deposited at said cathode and oxygen is evolved at said anode, and then causing the electrolyzed solution to flow in a second path leading back to said etching chamber.

collecting the oxygen anodically evolved in said electrolysis cell; and introducing said collected oxygen into said electrolyzed solution and intensively mixing the oxygen with the solution in a portion of said second path of said solution leading back to said etching chamber.

2. Method according to claim 1 in which ammonia is added to said collected oxygen for introduction therewith into said electrolyzed solution.

3. Method according to claim 2 in which water vapor collected with said collected oxygen is removed by condensation before said collected oxygen is introduced into said first part of said solution and the water condensate is used for rinsing work pieces after they have been etched in said etching chamber.

4. Method according to claim 1 in which said solution withdrawn from said etching chamber contains catalyst particles suspended therein and in which said solution withdrawn said etching chamber in filtered so as to prevent said particles from entering said electrolysis cell with said first part of said withdrawn solution passing through said electrolysis cell, said first portion of said withdrawn solution being used to carry catalyst particles blocked by said filtering operation back to said etching chamber through a liquid jet pump which operates to draw said collected oxygen and to mix it into said solution.

5. Apparatus for regenerating an ammoniacal etching solution containing catalyst particles for promoting reoxidation, comprising:

means for removing said ammoniacal etching solution from an etching chamber for filtering out said particles from a portion of the so removed solution, and for leading the remainder thereof with said particles therein, back to said etching chamber;

means for electrolyzing said filtered portion of said etching solution for removal of metal ions therefrom as well as for evolution of oxygen therefrom, and for leading the electrolyzed etching solution back to said etching chamber, and means for collecting oxygen from said electrolyzing means and for introducing and thoroughly mixing said oxygen into said unfiltered remainder solution in its return to said etching chamber.

6. Apparatus according to claim 5, in which means for controllably admitting ammonia gas into said collected oxygen are provided which connect with a duct leading from said oxygen collecting means to said means for introducing and mixing oxygen into said unfiltered remainder solution.

7. Apparatus according to claim 5, in whch said means for introducing and mixing oxygen into said unfiltered remainder solution is a liquid jet pump in which said remainder solution is the working liquid and in which a suction inlet is provided for the oxygen.

8. Apparatus according to claim 7, in which a pressure relief branch line is connected, upstream of said jet pump, to said means for leading said remainder solution back to said etching chamber.

9. Apparatus according to claim 8 in which a catch basin is interposed between said means for removing said solution from said etching chamber and said filtering means, said catch basin having an outlet line leading towards said filtering means, a first inlet line from said etching chamber, and a second inlet line connecting to said pressure relief line.

10. Apparatus according to claim 9 in which said first inlet line of said catch basin is a gravity-feed line and in which said filtering means is located vertically above said liquid jet pump to enable gravity feed of said remainder solution to said liquid jet pump.

11. Apparatus according to claim 10, in which said filtering means includes a cylindrical filter element on a vertical axis and disposed vertically above said filter jet pump.

12. Apparatus according to claim 5 equipped with a rinsing chamber (2) for work pieces etched in and removed from said etching chamber, in which apparatus water condensing means (42) are interposed between said oxygen collecting means and said means for introducing and mixing oxygen into said solution, and in which means are also ptovided for delivery of condensate, produced by said condensing means, to said rinsing chamber (2) for rinsing said work pieces.

13. Apparatus according to claim 12, in which said electrolysis cell is equipped with means (43) for controlling the temperature of said solution in said cell, in order to control the rate at which said condensing means (42) produces said condensate.

14. Apparatus according to claim 13, in which said electrolysis cell is provided with a cooling water jacket forming part of said temperature control means (43).

15. Apparatus for regenerating an ammoniacal etching solution by the addition of oxygen thereto, said apparatus having an etching chamber (1) a first etching solution transport lines (3–7) for taking etching solution away from said etching chamber, a second etching solution transport line (9) for returning etching solution to said etching chamber electrolysis cell, a first connecting line (16, 16′, 16″) for furnishing to said cell (13) a part of said solution passing through said first duct means (3–7) and a second connecting line (24) for furnishing electrolyzed solution of reduced metal ion content from said cell to said etching chamber said apparatus further comprising:

a fluid jet pump (10) interposed in said second etching solution transport line (9) for operation with said etching solution as a working liquid and having a gas suction inlet (11), and a connecting gas line (12) connected to said suction inlet(11) of said fluid jet pump (10) and also connected so as to be fed by oxygen evolved at the anode (17) of said electolysis cell (13).

16. Apparatus according to claim 13, in which means (18–21) are provided for controllably feeding ammonia gas into said connecting gas line in a manner compensating variations of pH detected in etching solution delivered by said first etching solution transport line.

17. Apparatus according to claim 15 equipped with a rinsing chamber (2) for work pieces etched in and removed from said etching chamber, in which apparatus water condensing means (42) are interposed in said connecting gas line (12) and means are also provided for delivery of condensate, produced by said condensing means, to said rinsing chamber (2) for rinsing said work pieces.

18. Apparatus according to claim 17, in which said electrolysis cell is equipped with means (43) for controlling the temperature of said solution in said cell, in order to control the rate at which said condensing means (42) produces said condensate.

19. Apparatus according to claim 18, in which said electrolysis cell is provided with a cooling water jacket forming part of said temperature control means (43).

* * * * *